United States Patent [19]

Schlatter et al.

[11] Patent Number: 5,040,551

[45] Date of Patent: Aug. 20, 1991

[54] OPTIMIZING THE OXIDATION OF CARBON MONOXIDE

[75] Inventors: James C. Schlatter, Sunnyvale; R. A. DallaBetta, Mountain View; Glenn C. Morrison, Sunnyvale; Jane A. Nikkel, San Jose, all of Calif.

[73] Assignee: Catalytica, Inc., Mountain View, Calif.

[21] Appl. No.: 265,882

[22] Filed: Nov. 1, 1988

[51] Int. Cl.[5] ..... A24B 15/28; A24B 15/30

[52] U.S. Cl. ..... 131/359; 131/369; 131/334; 44/542

[58] Field of Search ..... 131/359, 369, 365, 331, 131/332, 333, 334, 341, 342, 343; 44/542, 10 R

[56] References Cited

U.S. PATENT DOCUMENTS

| | | | |
|---|---|---|---|
| 3,368,566 | 2/1968 | Avedikian . | |
| 4,044,777 | 8/1977 | Boyd et al. | 131/359 |
| 4,079,742 | 3/1978 | Rainer et al. . | |
| 4,142,534 | 3/1979 | Branti . | |
| 4,182,348 | 1/1980 | Seehofer et al. . | |
| 4,215,708 | 8/1980 | Tuskamoto . | |
| 4,231,377 | 11/1980 | Cline et al. | 131/365 |
| 4,317,460 | 3/1982 | Dale et al. . | |
| 4,397,321 | 8/1983 | Stuetz . | |
| 4,589,428 | 5/1986 | Keritsis . | |
| 4,714,082 | 12/1987 | Banerjee et al. . | |
| 4,732,168 | 3/1988 | Resce . | |
| 4,756,318 | 7/1988 | Shannon et al. . | |

FOREIGN PATENT DOCUMENTS

| | | | |
|---|---|---|---|
| 174645 | 9/1985 | European Pat. Off. . | |
| 212234 | 7/1986 | European Pat. Off. . | |
| 236992 | 3/1987 | European Pat. Off. . | |
| 245732 | 5/1987 | European Pat. Off. . | |
| 254842 | 6/1987 | European Pat. Off. . | |
| 254848 | 6/1987 | European Pat. Off. . | |
| 270916 | 11/1987 | European Pat. Off. . | |
| 271036 | 12/1987 | European Pat. Off. . | |
| 277519 | 1/1988 | European Pat. Off. . | |
| 0096696 | 6/1983 | Japan | 44/542 |
| 0117286 | 7/1983 | Japan | 44/542 |

*Primary Examiner*—V. Millin

*Attorney, Agent, or Firm*—E. Thomas Wheelock

[57] ABSTRACT

A method for reducing the amount of carbon monoxide produced in the combustion of carbonaceous fuels. The fuel is coated on at least a portion of its exterior surface with a microporous layer of solid particulate matter which is non-combustible at temperatures in which the carbonaceous fuel combusts. This invention is particularly applicable in the reduction of carbon monoxide in the burning of carbonaceous fuel elements found in currently available "smokeless" cigarettes.

45 Claims, 1 Drawing Sheet

OPTIMIZING THE OXIDATION OF CARBON MONOXIDE

TECHNICAL FIELD OF INVENTION

In the burning of virtually any carbonaceous fuel, carbon monoxide is readily produced. The present invention deals with a method for substantially reducing carbon monoxide as a combustion product while promoting its oxidation to carbon dioxide during the combustion process.

BACKGROUND OF THE INVENTION

When carbon is burned in air, the dominant gaseous product of the combustion reaction is carbon dioxide. However, low levels of carbon monoxide are almost always present in the product gases. Because carbon monoxide exhibits adverse health effects, it is desirable to minimize its concentration in combustion products.

The need to reduce carbon monoxide levels during the combustion of a carbonaceous fuel has become a priority in light of recently introduced "smokeless" cigarettes. Such articles are described in U.S. Pat. No. 4,756,318, which issued on July 12, 1988, and U.S. Pat. No. 4,732,168, which issued on Mar. 22, 1988. These patents teach a smoking article which is capable of producing substantial quantities of aerosol, both initially and over the useful life of the product without significant thermal degradation of the aerosol former.

The smoking article is generally taught to comprise a short, combustible, carbonaceous fuel element and, optionally, a separate tobacco jacket around a portion of the aerosol generating means. This combination is taught to present the user with the taste, feel and aroma associated with smoking conventional cigarettes while not requiring the burning of tobacco.

It is taught in the above-referenced patents that the fuel element should comprise carbonaceous materials which can be derived from virtually any of the numerous carbon sources currently known. It is taught that preferably the carbonaceous material is obtained by the pyrolysis or carbonization of cellulosic materials, such as wood, cotton, rayon, tobacco, coconut, paper and the like, although carbonaceous materials from other sources can also be used. It is further taught that the carbonaceous fuel element should be capable of being ignited by a conventional cigarette lighter. These burning characteristics are taught to be obtainable from cellulosic material which has been pyrolyzed at temperatures between about 400° C. to about 1000° C. in an inert atmosphere or under vacuum.

Such carbonaceous fuel elements are also taught to optionally contain such diverse components as oxidizing agents to render the fuel element ignitable by a cigarette lighter, glow retardants or other type or combustion modifying agents such as sodium chloride to improve smoldering and tobacco extracts for flavor. These elements are generally formed as a pressed or extruded mass of carbon prepared from a powdered carbon and binder by conventional press forming or extrusion techniques. Unfortunately, regardless of the heretofore additives employed or physical confirmation of the carbonaceous fuel element, relatively high levels of carbon monoxide, generally at least about 10 milligrams is the product of burning carbonaceous fuel elements in the "smokeless" cigarettes made the subject of the above-referenced patents. This level of carbon monoxide is high for a product intended for human consumption. As a result, the need has arisen to develop a method of reducing the amount of carbon monoxide produced in the combustion of a carbonaceous fuel element.

DESCRIPTION OF THE DRAWINGS

The present invention will be more readily visualized when considering the following disclosure and appended drawings wherein.

SUMMARY OF THE INVENTION

The present invention deals with a method of producing a composite carbonaceous fuel element and the fuel element itself produced by that process. The invention results in the reduction of carbon monoxide produced during its combustion.

The method comprises applying a coating on at least a portion of the exterior surface of the carbonaceous fuel element as a microporous layer of solid particulate matter which is characterized as being substantially noncombustible at temperatures in which the carbonaceous fuel combusts. The invention is particularly applicable in reducing levels of carbon monoxide produced in the combustion of the carbonaceous fuel element of what has been come to be known as a "smokeless" cigarette.

DETAILED DESCRIPTION OF THE INVENTION

Figure 1:
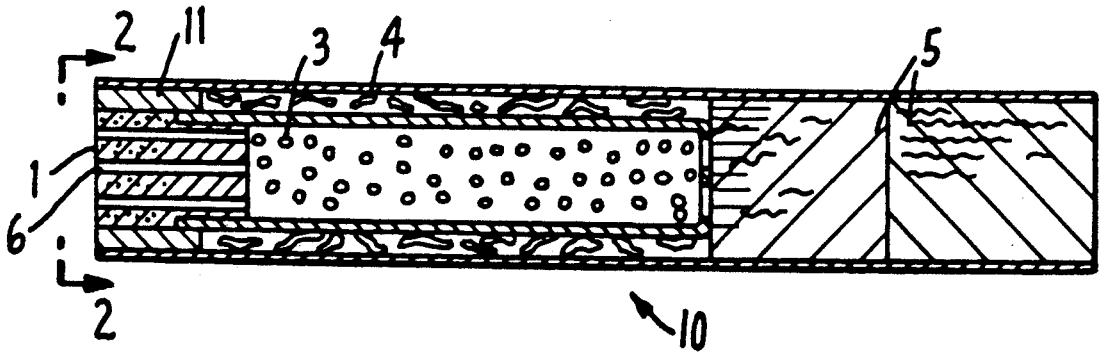
(PRIOR ART) FIG. 1.
FIG. 1 is a cross-sectional schematic view of a typical "smokeless" cigarette of the prior art.

As previously noted, U.S. Pat. Nos. 4,756,318 and 4,732,168 disclose smoking articles which differ from present day cigarettes in that the burning of conventional tobacco is substantially eliminated. FIG. 1 shows a typical schematic depiction of such a smoking article 10 in which fuel element 1 comprising a short, combustible, carbonaceous material is placed at one extremity of the member. A physically separate aerosol generating means 3, which includes an aerosol forming substance, is placed proximate to carbonaceous fuel element 1 to enable heat generated from the burning of the fuel element to generate an aerosol which provides the user with a simulation of a conventional tobacco-burning cigarette. Optionally, the smoking article can be jacketed in a thin tobacco sleeve 4 to provide the feel of a conventional tobacco containing cigarette which abuts filter means 5.

Figure 2:
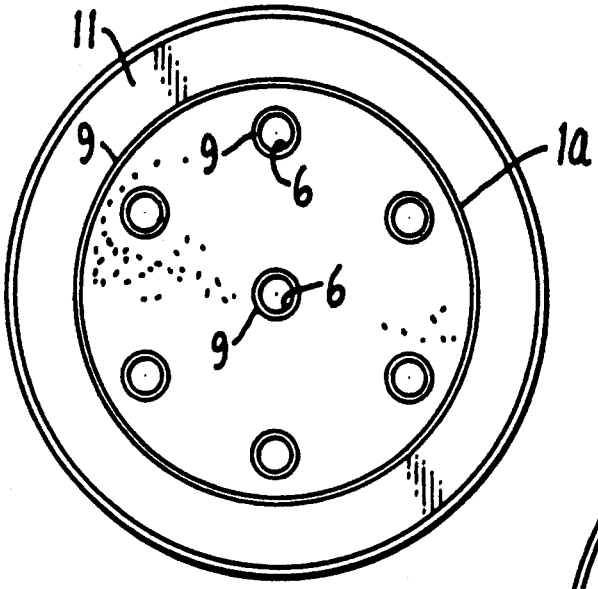
FIGS. 2 and 3 are two variations of fuel elements shown in cross section taken along line 2—2 of FIG. 1.
Figure 3:
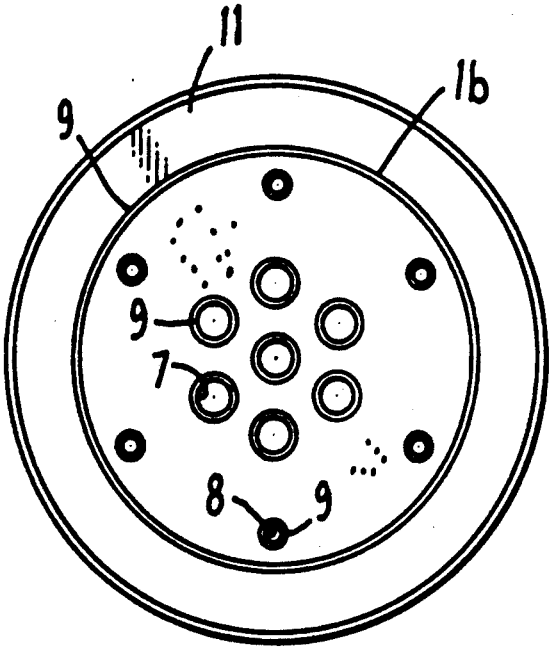

Characteristically, carbonaceous fuel element 1 is provided with one or more longitudinally extending passageways shown as openings 6, 7 and 8 in FIGS. 2 and 3 which depict carbonaceous fuel element 1 taken along cross section 2—2 as elements 1*a* and 1*b* surrounded by insulation 11 in each case. These passageways assist in the controlled transfer of heat energy from fuel element 1 to aerosol generating means 3, which is important both in terms of transferring enough heat to produce sufficient aerosol and in terms of avoiding the transfer of so much heat that the aerosol former is degraded. It is taught that these passageways provide porosity and increase early heat transfer to the substrate by increasing the amount of hot gases which reach the substrate. They also tend to increase the rate of burning.

The disclosure found in U.S. Pat. No., 4,756,318 recognizes that carbon monoxide output in the above-described smoking articles may be a problem, noting that high convective heat transfer tends to produce a higher carbon monoxide output. It is taught by the cited patent that to reduce carbon monoxide levels, fewer passageways or higher density fuel elements may be employed, but that such changes generally tend to make the fuel element more difficult to ignite and to decrease the convective heat transfer, thereby lowering the aerosol delivery rate and amount. To overcome this problem, the patentees teach that passageways arranged which are closely spaced, as in FIG. 3, tend to burn out or coalesce to form one passageway, at least at the lighted end, such that the amount of carbon monoxide in the combustion products is generally lower than in the equivalent, but widely spaced, passageway arrangement (FIG. 2).

Nevertheless, it has been determined that regardless of the arrangement of passageways 6, 7 and 8, carbon monoxide output from such smoking devices is generally at a 10 mg or greater level which is unacceptable when designing a product whose output is intended for human consumption.

It has surprisingly been determined that significant reduction in carbon monoxide levels can be achieved if coating 9 comprising a substantially uniform microporous layer of a solid, particulate material, which is characterized as being substantially noncombustible at temperatures in which the carbonaceous fuel combusts, is employed. Most surprisingly, levels of carbon monoxide reduction can be achieved in employing such a uniform, microporous layer far superior than those levels achievable by employing the same solid, particulate matter uniformly mixed throughout the body of the carbonaceous fuel element.

According to the present invention, a thin, microporous coating of a noncombustible material is supplied to some or all of the exposed surfaces of a carbonaceous fuel. In dealing with fuel element 1 of a "smokeless" cigarette, it has been found that applying such a coating within passageways 6, 7 and 8 is particularly advantageous.

Although any coating method can be used to create the microporous layer of solid, particulate matter, a convenient procedure is to form a suspension of finely divided solid particles in a liquid such as water and to then expose the carbonaceous fuel element to the suspension. The exposure can be via dipping, spraying, flowing the suspension through the carbonaceous fuel element, or by any other means, which would be readily apparent to those skilled in this art. When the carbonaceous fuel element is dried, the desired microporous coating is left behind on its surface.

The most desirable coating materials for use in the practice of the present invention are those which form a microporous layer on the carbonaceous fuel element surface. The coating should not melt at the combustion temperature of the fuel, typically between 800° C.-1200° C. High melting oxides such as alumina, titania, silica, silica-alumina, zirconia, ceria, zeolite, zirconium phosphate and mixtures thereof, are particularly suitable for use in the practice of the present invention.

The most desirable coating thickness, expressed as a weight percent of the fuel element, depends upon the needs of the particular application. A thick coating provides especially low values of carbon monoxide concentration, but in the extreme, interferes too severely with the burning of the carbonaceous product itself. Inhibited burning is reflected in low values of heat output as noted in the tabulated results presented below. A thin coating is less inhibitive of the combustion process, but at the same time, allows somewhat higher levels of carbon monoxide to be produced. Accordingly, the coating thickness can be adjusted to meet the requirements of the intended application. In general, however, the amount of coating should range between approximately 0.1 to 20 percent by weight based upon the weight of the fuel element with a preferred range of between 0.5 and 10 percent by weight and approximately 1.0 to 5.0 percent by weight as the most preferred range.

If desired, carbon monoxide levels can be reduced even further by the addition of catalytic ingredients which promote the oxidation of carbon monoxide to carbon dioxide. Among useful catalytica ingredients are platinum group metals, such as platinum and palladium and transition metals and/or their oxides such as iron, copper, chromium, cobalt and manganese. These catalytic ingredients can be incorporated into the coating material either before or after the coating is applied to the surface of the carbonaceous fuel. Methods of applying these catalytic ingredients to an oxide support are exceedingly well known to those skilled in this art.

EXAMPLE 1

Figure 4:
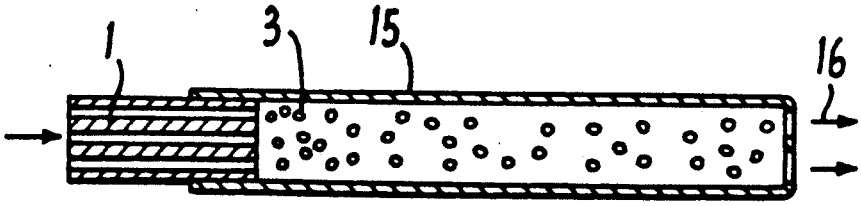
FIG. 4 is a schematic cross-sectional view of a device employed for the testing of combustion properties of carbonaceous fuel elements.

The smoking article as depicted schematically in FIG. 4 was employed to generate the necessary "smoke" for analysis. As such, carbonaceous fuel element 1 was abutted to aerosol generating means 3 which are in the form of beads nested within cylindrical, aluminum casing 15. The distal end of said casing is functionally connected to a smoking and analyzing machine which draws smoke in the direction of arrow 16.

Carbonaceous fuel element 1 was configured as a cylinder 4.5 mm in diameter and 10 mm long and inserted into the end of aluminum capsule 15. The smoking and analyzing machine (not shown) was adjusted to draw 35 ml of air through the fuel once every 2 seconds which was repeated every 60 seconds after it was ignited. Each "puff" of air drawn through the fuel was passed into nondispersive, infrared analyzers to measure the concentrations of carbon monoxide and carbon dioxide. These values were used to calculate the number of milligrams of the two components of each puff, and these values in turn were summed to give the total amount of carbon monoxide produced during each complete test. Each test was conducted until the fuel was burned to the extent that it could no longer sustain combustion, typically 8 to 11 puffs. The heat generated during each test was calculated from the amount of each combustion product formed and its respective thermodynamic heat of formation. Each value shown in the examples which follow is the average of 6 replicate tests.

In each case, coating 9 was prepared as follows. Into a 1.13 liter capacity, porcelain milling jar was placed 100 grams of gamma-phase alumina having a 100 $m^2/g$ surface area, 24 ml of concentrated nitric acid, 210 ml of water and 50 cylindrical milling media, ¾" in diameter. The sealed jar was then placed on a standard ball mill machine. The alumina particles looked nominally round, and the milling continued until the particles were reduced to approximately 2 microns or smaller in diameter. Although the required milling time depends upon the initial particle size of the alumina and the pH of the milling solution, milling was generally carried out between 4 and 48 hours. Milling was generally stopped periodically so that a few drops of the mixture can be withdrawn, smeared onto a glass slide and examined under a microscope. Solid particles should appear closely packed with very small (i.e., less than 0.1 microns in diameter) particles filling spaces between larger particles. The pH of the mixture generally increased from an initial value of 2 or less to a final value of 2.5 to 3 when milling was complete. The contents of the ball mill jar were used directly to coat fuels or alternatively further diluted with water in order to form thinner coatings. When employing concentrations such as recited above, an approximate 30 percent weight solids suspension is provided.

As noted previously, the carbonaceous fuel element can be coated in a number of ways. In this instance, however, the fuel element was pushed 2 to 3 mm into the end of a 1 inch length of 4 mm (i.d.) plastic tubing. The tubing was clamped vertically with the carbonaceous fuel element at its bottom. Approximately 0.2 ml of the coating mixture was then dropped into the tube so that the entire end of the fuel was covered. After a 20 second wait for the mixture to seep into the channels of the fuel, an air hose was snugly attached to the top of the plastic tube and a stream of air at 3 lbs. per square inch pressure employed to blow excess solution through the fuel and out its bottom end. The carbonaceous fuel element was then removed from the plastic tube and dried for 30 min. at a temperature of 100° C. When the undiluted (30 wt. percent solids) coating was used, the resulting coating was approximately 10 percent by weight based upon the weight of the carbonaceous fuel element, while the finished mass of the coated fuel was approximately 150 mg. Following this procedure, coating 9 was formed only within holes 6, 7 and 8 and not on the peripheral surface of the fuel element.

A comparison of such alumina-coated fuels with uncoated fuels and with fuels containing the same alumina mixed throughout the fuel pellet uniformly is presented. In each instance, all carbonaceous fuel elements 1 were provided with the same wide spaced, seven hole pattern as depicted in FIG. 2.

TABLE I

| Alumina Location | Wt. % Alumina (approx.) | mgCO | Calories |
|---|---|---|---|
| None | 0 | 12.8 | 100 |
| Coating | 1 | 4.4 | 100 |
| Coating | 3 | 0.8 | 70 |
| Throughout | 5 | 4.9 | 133 |
| Coating | 5 | 0.8 | 56 |
| Throughout | 10 | 5.7 | 158 |
| Coating | 10 | 0.7 | 34 |

Several observations can be made based upon the above-recited data. Firstly, far superior results are achieved by the practice of the present invention in creating a microporous layer of solid, particulate matter than is achievable when uniformly combining the same particulate matter throughout the carbonaceous fuel element. Secondly, as the weight of particulate matter in the coating increases, thus increasing the coating thickness, the combustion of the carbonaceous fuel element is depressed as evidenced by the caloric values provided above. As previously noted, ideally, the carbonaceous fuel element should be provided with a microporous layer of a sufficient thickness to substantially reduce the amount of carbon monoxide produced in the combustion of the carbonaceous fuel, but be sufficiently thin as to not unduly prevent the carbonaceous fuel from combusting. In this instance, a coating of approximately 3 percent alumina particles would be superior to one having 10 percent alumina particles for the reduction in carbon monoxide in increasing from 3 to 10 percent is not significant, while the caloric output achieved during the burning process is approximately twice as high for a composite having 3 percent alumina particles rather than 10 percent.

EXAMPLE 2

The smoking article of Example 1 was next prepared where approximately 5 percent by weight palladium on gamma-phase alumina was employed on and mixed within the fuel element. The following results were achieved:

TABLE II

| Alumina Location | Wt. % Pd/Alumina (approx.) | mgCO | Calories |
|---|---|---|---|
| Throughout | 10 | 2.1 | 134 |
| Coated | 3 | 0.7 | 72 |

It is noted that the coated carbonaceous fuel elements produced significantly less carbon monoxide than did comparable fuel elements containing even a greater amount of catalyst-coated alumina dispersed throughout the body of the carbonaceous fuel.

EXAMPLE 3

The smoking article of Example 1 was again prepared with the modifications now being that alphaphase alumina was used and that the narrow 7 hole, central pattern of passageways, as depicted in FIG. 3 was employed with the exception being that the tabulated data labeled "throughout" was conducted on fuel elements which did not contain peripheral passageway 8.

TABLE III

| Alumina Location | Wt. % Alumina (approx.) | mgCO | Calories |
|---|---|---|---|
| None | 0 | 14.0 | 104 |
| Coated | 1 | 8.6 | 93 |
| Coated | 3 | 4.0 | 81 |
| Throughout | 5 | 11.7 | 132 |
| Throughout | 10 | 7.1 | 110 |

EXAMPLE 4

The smoking article of Example 1 having the fuel element of Example 3 was again used. The particulate matter consisted of gamma-phase alumina which had been coated with 2.5 percent by weight palladium. The following results were observed:

TABLE IV

| Alumina Location | Wt. % Pd/Alumina (approx.) | mgCO | Calories |
|---|---|---|---|
| None | 0 | 14.0 | 104 |
| Coated | 1 | 4.1 | 128 |
| Coated | 3 | 2.9 | 107 |
| Coated | 5 | 1.0 | 75 |
| Throughout | 10 | 11.2 | 134 |

Again, the same conclusion can be reached that coated carbonaceous fuel elements are far superior in exhibiting reduced carbon monoxide levels than untreated or elements which have been uniformly dispersed with the same particulate material.

EXAMPLE 5

Once again, Example 1 is repeated employing the same carbonaceous fuel element of Example 3 while, now, the gamma-alumina has been replaced by cerium oxide ($CeO_2$), yielding the following data:

TABLE V

| Cerium Oxide Location | Wt. % $CeO_2$ (approx.) | mgCO | Calories |
|---|---|---|---|
| None | 0 | 14.0 | 104 |
| Coated | 3 | 12.0 | 108 |
| Coated | 5 | 7.4 | 90 |
| Coated | 10 | 1.5 | 57 |

EXAMPLE 6

In the smoking article of Example 1, gammaphase alumina was coated upon carbonaceous fuel elements which had previously been modified to contain a uniform dispersion of 5 weight percent gamma-phase alumina. Each of the fuel elements was provided with a 7 hole pattern of passageways as depicted in FIG. 2. The following data were observed:

TABLE VI

| Description of Fuel | Wt. % Coating (approx.) | mgCO | Calories |
|---|---|---|---|
| Plain Carbon | 0 | 12.8 | 100 |
| 5 Wt. % Alumina throughout | 0 | 1.5 | 99 |
| 5 Wt. % Throughout, coated | 5 | 0.3 | 45 |
| 5 Wt. % Throughout, coated | 10 | 0.8 | 35 |

As such, it was noted that even when a carbonaceous fuel element has been modified to contain a uniform dispersion of particulate material such as alumina, improvements can be realized by further coating the carbonaceous element pursuant to the present invention.

Although it is not the intent to be bound by any particular rationale in explaining the scientific underpinning of the present invention, it is hypothesized that the carbon monoxide content of combustion effluent gases will essentially be determined by the relative kinetics of carbon monoxide and carbon dioxide formation at the surface of the carbonaceous fuel element matrix. Both carbon dioxide and carbon monoxide are primary combustion products and the carbon monoxide/carbon dioxide ratio sharply increases with increasing temperature of combustion. In fact, the temperature dependence of the carbon monoxide to carbon dioxide ratio can be conveniently expressed by the relation $CO/CO_2 = 10^{3.4} e^{-12,400/RT}$ which has been found to be reasonably valid in the temperature range of 400° C.–2000° C. From this relationship, it is observed that factors which tend to lower the reaction vigor, therefore the corresponding heat evolution, will reduce the resulting combustion temperature and also significantly decrease the carbon monoxide content of the resulting effluent.

Regardless of the explanation for the unexpected results achieved in practicing the present invention, it is quite obvious that this invention does result in certain well defined advantages when compared to alternative attempts to reduce carbon monoxide effluent such as by dispersing particulate matter throughout such elements. Obviously, carbon monoxide levels are lower in practicing the present invention than are attainable by other methods. In addition, the amounts of material required to treat the surface of the fuel element are appreciably lower than the amounts required for putting additives throughout the carbonaceous fuels. The present method has been show to be effective for any hole pattern in a carbonaceous fuel element while previously known methods are less effective for closely spaced hole patterns than for those which are widely spaced.

It is further observed that the present method does not interfere with normal production procedures for carbonaceous fuel elements or with the strengths of the resulting fuels. Prior methods which change the composition of the fuel mixture often result in poorer crush strength of the formed carbonaceous products. In addition, the final properties of the fuel element, including carbon monoxide production, burning temperature and burning efficiency can be adjusted by adjusting the amount, composition and physical properties of the coating. It would not be feasible to make such adjustments by introducing additives throughout the fuel. Lastly, the present invention can be employed in modifying pre-existing carbonaceous substrates so that post production treatment is now, for the first time, possible.

We claim:

1. A composite carbonaceous fuel element comprising a combustible carbonaceous fuel having a coating on at least a portion of its exterior surface, said coating comprising a microporous layer of solid particulate matter being characterized as being substantially noncombustible at temperatures in which said carbonaceous fuel combusts.

2. The composite carbonaceous fuel element of claim 1 wherein said microporous layer is of a sufficient thickness to substantially reduce the amount of carbon monoxide produced in the combustion of said carbonaceous fuel.

3. The composite carbonaceous fuel element of claim 1 wherein said microporous layer is sufficiently thin as to not unduly prevent said carbonaceous fuel from combusting.

4. The composite carbonaceous fuel element of claim 1 wherein said solid particulate matter comprises approximately between 0.1 to 20 percent by weight based upon the weight of said combustible carbonaceous fuel.

5. The composite carbonaceous fuel element of claim 1 wherein said solid particulate matter comprises approximately between 0.5 to 10 percent by weight based upon the weight of said combustible carbonaceous fuel.

6. The composite carbonaceous fuel element of claim 1 wherein said solid particulate matter comprises approximately between 1.0 to 5.0 percent by weight based upon the weight of said combustible carbonaceous fuel.

7. The composite carbonaceous fuel element of claim 1 wherein said solid particulate matter comprises nominally round particles having average diameters no greater than approximately 2 microns.

8. The composite carbonaceous fuel element of claim 1 wherein said solid particulate matter comprises a metal oxide.

9. The composite carbonaceous fuel element of claim 8 wherein said metal oxide comprises one or more members selected from the group consisting of alumina, silica, silica-alumina, zirconia, ceria, titania, zeolite and zirconium phosphate.

10. The composite carbonaceous fuel element of claim 8 wherein said solid particulate matter further comprises a catalyst to promote the oxidation of carbon monoxide to carbon dioxide.

11. The composite carbonaceous fuel element of claim 10 wherein said catalyst comprises a platinum group metal.

12. The composite carbonaceous fuel element of claim 10 wherein said catalyst comprises one or more members selected from the group consisting of iron, copper, chromium, cobalt, manganese and the oxides thereof.

13. In a cigarette-type smoking article which includes a combustible carbonaceous fuel element, the improvement comprising providing a coating on at least a portion of the exterior surface of said fuel element, said coating comprising a microporous layer of solid particulate matter being characterized as being substantially non-combustible at temperatures in which said fuel element combusts.

14. The cigarette-type smoking article of claim 13 wherein said microporous layer is of a sufficient thickness to substantially reduce the amount of carbon monoxide produced in the combustion of said carbonaceous fuel.

15. The cigarette-type smoking article of claim 13 wherein said microporous layer is sufficiently thin as to not unduly prevent said carbonaceous fuel from combusting.

16. The cigarette-type smoking article of claim 13 wherein said solid particulate matter comprises approximately between 0.1 to 20 percent by weight based upon the weight of said combustible carbonaceous fuel.

17. The cigarette-type smoking article of claim 13 wherein said solid particulate matter comprises approximately between 0.5 to 10 percent by weight based upon the weight of said combustible carbonaceous fuel.

18. The cigarette-type smoking article of claim 13 wherein said solid particulate matter comprises approximately between 1.0 to 5.0 percent by weight based upon the weight of said combustible carbonaceous fuel.

19. The cigarette-type smoking article of claim 13 wherein said solid particulate matter comprises nominally round particles having average diameters no greater than approximately 2 microns.

20. The cigarette-type smoking article of claim 13 wherein said solid particulate matter comprises a metal oxide.

21. The cigarette-type smoking article of claim 20 wherein said metal oxide comprises one or more members selected from the group consisting of alumina, silica, silica-alumina, zirconia, ceria, titania, zeolite and zirconium phosphate.

22. The cigarette-type smoking article of claim 20 wherein said solid particulate matter further comprises a catalyst to promote the oxidation of carbon monoxide to carbon dioxide.

23. The cigarette-type smoking article of claim 22 wherein said catalyst comprises a platinum group metal.

24. The cigarette-type smoking article of claim 22 wherein said catalyst comprises one or more members selected from the group consisting of iron, copper, chromium, cobalt, manganese and the oxides thereof.

25. A method for reducing the amount of carbon monoxide produced in the combustion of a carbonaceous fuel comprising coating on the exterior surface of said carbonaceous fuel a microporous layer of solid particulate matter being characterized as being substantially non-combustible at temperatures in which said carbonaceous fuel combusts.

26. The method of claim 25 wherein said microporous layer is of a sufficient thickness to substantially reduce the amount of carbon monoxide produced in the combustion of said carbonaceous fuel.

27. The method of claim 25 wherein said microporous layer is sufficiently thin as to not unduly prevent said carbonaceous fuel from combusting.

28. The method of claim 25 wherein said solid particulate matter comprises approximately between 0.1 to 20 percent by weight based upon the weight of said combustible carbonaceous fuel.

29. The method of claim 25 wherein said solid particulate matter comprises approximately between 0.5 to 10 percent by weight based upon the weight of said combustible carbonaceous fuel.

30. The method of claim 25 wherein said solid particulate matter comprises approximately between 1.0 to 5.0 percent by weight based upon the weight of said combustible carbonaceous fuel.

31. The method of claim 25 wherein said solid particulate matter comprises nominally round particles having average diameters no greater than approximately 2 microns.

32. The method of claim 25 wherein said solid particulate matter comprises a metal oxide.

33. The method of claim 32 wherein said metal oxide comprises one or more members selected from the group consisting of alumina, silica, silica-alumina, zirconia, ceria, titania, zeolite and zirconium phosphate.

34. The method of claim 32 wherein said solid particulate matter further comprises a catalyst to promote the oxidation of carbon monoxide to carbon monoxide to carbon dioxide.

35. The method of claim 34 wherein said catalyst comprises a platinum group metal.

36. The method of claim 34 wherein said catalyst comprises one or more members selected from the group consisting of iron, copper, chromium, cobalt, manganese and the oxides thereof.

37. A process for reducing the amount of carbon monoxide produced in the combustion of a carbonaceous fuel comprising preparing a suspension of finely divided solid particles in a liquid carrier, said solid particles being characterized as being substantially non-combustible at temperatures in which said carbonaceous fuel combusts, applying said suspension to at least a portion of the surface of said carbonaceous fuel and drying said suspension of said liquid carrier forming a microporous layer of said solid particles on said carbonaceous fuel.

38. The process of claim 37 wherein said liquid carrier comprises water.

39. The process of claim 37 wherein said solid particles comprise a metal oxide.

40. The process of claim 39 wherein said metal oxide comprises one or more members selected from the group consisting of alumina, silica, silica-alumina, zirconia, ceria, titania, zeolite and zirconium phosphate.

41. The process of claim 37 wherein said solid particles comprise approximately between 0.1 to 20 percent by weight based upon the weight of said combustible carbonaceous fuel.

42. The process of claim 37 wherein said solid particles comprise approximately between 0.5 to 10.0 percent by weight based upon the weight of said combustible carbonaceous fuel.

43. The process of claim 37 wherein said solid particles comprise approximately between 1.0 to 5.0 percent by weight based upon the weight of said combustible carbonaceous fuel.

44. The process of claim 37 wherein said solid particles are nominally round having average diameters no greater than approximately 2 microns.

45. The process of claim 37 wherein said microporous layer is sufficiently thin as to not unduly prevent said carbonaceous fuel from combusting.

* * * * *